US005899056A

United States Patent [19]

Stahlecker et al.

[11] Patent Number: 5,899,056

[45] Date of Patent: May 4, 1999

[54] SPINNING PROCESS FOR PRODUCING A YARN

[75] Inventors: Fritz Stahlecker, Josef-Neidhart-Strasse 18, 73337 Bad Überkingen, Germany; Hans Stahlecker, Haldenstrasse 20, 73079 Süssen, Germany

[73] Assignees: Fritz Stahlecker, Bad Ueberkingen; Hans Stahlecker, Suessen, both of Germany

[21] Appl. No.: 08/906,854

[22] Filed: Aug. 6, 1997

[30] Foreign Application Priority Data

Aug. 14, 1996 [DE] Germany ..... 196 32 742

[51] Int. Cl.[6] ..... D01H 4/00

[52] U.S. Cl. ..... 57/401; 57/13; 57/332; 57/335; 57/400

[58] Field of Search ..... 57/400, 401, 408, 57/409, 411, 13, 403, 332, 335, 328

[56] References Cited

U.S. PATENT DOCUMENTS

| | | | |
|---|---|---|---|
| 4,539,806 | 9/1985 | Stahlecker | 57/400 |
| 4,753,066 | 6/1988 | Briner et al. | 57/409 |
| 4,773,209 | 9/1988 | Briner et al. | 57/408 |
| 4,854,118 | 8/1989 | Briner et al. | 57/401 |
| 5,090,192 | 2/1992 | Stahlecker | 57/328 |
| 5,187,930 | 2/1993 | Stahlecker | 57/400 |
| 5,222,352 | 6/1993 | Stahlecker | 57/333 |
| 5,228,281 | 7/1993 | Stahlecker | 57/333 |
| 5,241,813 | 9/1993 | Rottmayr et al. | 57/401 |

FOREIGN PATENT DOCUMENTS

| | | | |
|---|---|---|---|
| 263761 | 8/1989 | Czechoslovakia . | |
| 2152957 | 8/1985 | United Kingdom | 57/400 |
| 8602953 | 5/1986 | WIPO | 57/400 |

*Primary Examiner*—William Stryjewski
*Attorney, Agent, or Firm*—Evenson McKeown Edwards & Lenahan, PLLC

[57] ABSTRACT

In a spinning process for producing a yarn, fiber material in the form of at least one sliver is opened to a fibrous veil consisting of single fibers, and is deposited on an air-permeable suctioned collecting surface. The speed of the fibrous veil transported on the collecting surface is preferably not higher than the speed of the drawn off yarn. Before reaching the yarn formation line located on the collecting surface, the fibrous veil is divided into a plurality of fiber accumulations and thereby pre-twisted to strands. The position and travelling direction of the strands on the collecting surface is defined by guiding edges of suction slits. The individual strands are guided off transversely to the yarn formation line, whereby the extent of the pre-twist and the extent of the transport force is determined by the angle of the strands to the yarn formation line. Pre-twisted strands are wound around each other along the yarn formation line so that a type of ply-twisted yarn arises.

46 Claims, 8 Drawing Sheets

3A
5A
8A
6A
7A
23A
28A
42
41
E
10A
12A
43
30A
9A
36
40

SPINNING PROCESS FOR PRODUCING A YARN

BACKGROUND AND SUMMARY OF THE INVENTION

This application claims the priority of German application 196 32 742.3 filed in Germany on Aug. 14, 1996, the disclosure of which is expressly incorporated by reference herein.

The present invention relates to a spinning process for producing a yarn in which slivers opened to single fibers are fed in the form of a fibrous veil to an air-permeable and suctioned collecting surface, and are then transported along a transport path by means of the collecting surface to a yarn formation line and from there are withdrawn transversely to the transport direction of the collecting surface as a yarn having a twist at a speed which at least approximates the transport speed of the collecting surface.

In the case of a spinning process of this kind (U.S. Pat. No. 5,241,813), the relation of the above named speeds to one another should prevent a crinkling of the fibers along the yarn formation line. Due to the high withdrawal speed, the dwelling time of the arising yarn tip in the yarn formation line is extremely short, so that the twist is not sufficiently imparted. This disadvantage is not improved by the separate twist-giving elements arranged downstream. There is the risk that the continually renewed tip of the formed yarn hangs from the withdrawn yarn or that at least thin spots occur in the yarn.

It is already known (CS patent 263 761) that a plurality of curved suction slits are arranged in circumferential direction to the collecting surface, by means of which suction slits the single fibers fed to the yarn formation line are divided into groups and fed to the yarn formation line at a favorable angle. In this case, however, a purely friction spinning process is involved, in which the single fibers are fed so at such speed to the yarn formation line that an undesirable crinkling takes place in the yarn formation area.

It is an object of the present invention to improve a process of the above mentioned type, in which the single fibers arriving at the yarn formation line are not crinkled, in such a way that a hanging of the arising yarn tip from the yarn is avoided.

This object has been achieved in accordance with the present invention in that the fibrous veil is gathered together into a plurality of strands along the transport path on the collecting surface, which strands receive a pre-twist before they reach the yarn formation line and which strands are united at the yarn formation line with the other strands and integrated in the forming yarn.

The pre-twist occurring in the strands before they reach the yarn formation line is achieved by means of lateral rolling of the fibrous veil which is divided into fiber strands during the transport on the collecting surface. It is hereby necessary to feed the strands at a certain angle to the yarn formation line, so that a motion component arises in yarn withdrawal direction, by means of which the twist is inserted into the strands. The other component extending in the direction of the collecting surface ensures a transport force of the single fibers so that the longitudinal tension is reduced, and a hanging down of the plurality of yarn tips is, in the present case, avoided. The size of the angle determines the extent of the twist and the level of the transport force. The single yarn tip known already from the prior art spinning process is divided into a plurality of yarn tips, each of which is provided with a pre-twist and which projects into the collecting surface. While the single fibers are already integrated into the strands, the strands are in turn wound into a kind of ply-twisted yarn, while the yarn is withdrawn along the yarn formation line. The formed yarn, with sufficient degree of strength, is marked by a particularly large cross sectional volume.

In one embodiment of the present invention it is provided that single fibers forming the fibrous veil are accelerated when they impact on the collecting surface. The single fibers are thus stretched and parallelized immediately after obtaining the open end necessary for the spinning process.

It is particularly purposeful when the fibrous veil is transported to the collecting surface directly after the fiber material has been opened to single fibers. The single fibers are then subjected to a mechanically controlled transport before they are accelerated too much by the opening device, for example a rotating opening roller. By taking up the single fibers during a phase of relatively low speed, the withdrawal speed of the arising yarn can be thereby reduced, and thus the risk of a hanging of the yarn tips can be avoided to a great extent.

The fibrous veil is advantageously formed of a plurality of fed slivers, preferably spaced from each other. The fibrous veil already contains the amount of single fibers required for the subsequent yarn cross section. Due to the distances between the slivers, they are more easily allocated to strands.

It can be favorable when the first strand in withdrawal direction of the yarn is fed more single fibers than the other strands. By means thereof, the outermost newly arising end of the yarn becomes blunter, which increases the stability of the structure of the arising yarn.

In certain circumstances it can be advantageous when the yarn formed at the yarn formation line is pressed by means of clamping to the collecting surface. Even at high withdrawal speeds, the twist is more securely imparted, and the yarn receives already in its formation phase a certain strengthening.

In a further embodiment of the present invention, it is provided that the twist imparted to the arising yarn is applied in a plurality of stages. A certain pre-consolidation is achieved in the formation stage, and in the final stage a definite twist is subsequently imparted. The nature of the finished yarn can be influenced by varying the extent of the pre-twist and the end twist.

Individual strands may be fed to the yarn formation line at varying angles. The extent of the twist and transport force is thus different in each strand, according to the desired nature of the finished yarn. It can be provided to arrange a sliver of a different fiber material to each strand.

For the purpose of the present invention, the strands are fed into the yarn formation line over a gently rounded transition point. A gradual transition from the thrust phase to the withdrawal phase results hereby, without tension differences occurring.

It is provided according to certain preferred embodiments of the invention that predominantly outer fibers are fed with the last strand in the withdrawal direction of the yarn. The last strand is then at a somewhat larger distance from the other strands, so the twisting of the forming yarn is almost already completed when the outer fibers are fed thereto. A softer outer yarn layer results, with a softer "grip" to the yarn.

In order to divide the fibrous veil into strands, the collecting surface is formed for the purpose of the present invention by the circumferential surface of a suction roller, in whose interior a suction insert is arranged which defines the transport path and the yarn formation line, which suction insert comprises suction slits which serve to divide the fibrous veil into strands, which suction slits end with an inclined guiding edge in withdrawal direction of the yarn in a main suction slit which defines the yarn formation line. Tests have shown that the strands follow the contour of the suction slits without difficulty.

The suction slits can be formed tapering in transport direction. This facilitates the dividing of the fibrous veil into strands, whereby the arriving single fibers are all gathered together funnel-like and more or less joined in one line.

The suction slits can begin downstream of a section of the transport path, starting with an initial suction zone extending over the entire effective width of the collecting surface. This has the advantage in that the fed slivers can be closely adjacent to one another or that, if required, a single, very wide sliver can be fed in.

Advantageously the main suction slit is more strongly suctioned than the suction slits arranged to the strands. The twist is thus applied more securely to the forming yarn in the yarn formation line.

The angle of inclination of the guiding edges of the suction slits can increase in transport direction. This means that at first the transport force prevails in the forming strands when the sliver is still very loose, and that subsequently the degree of twist is increased when the longitudinal tension in the strands increases.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
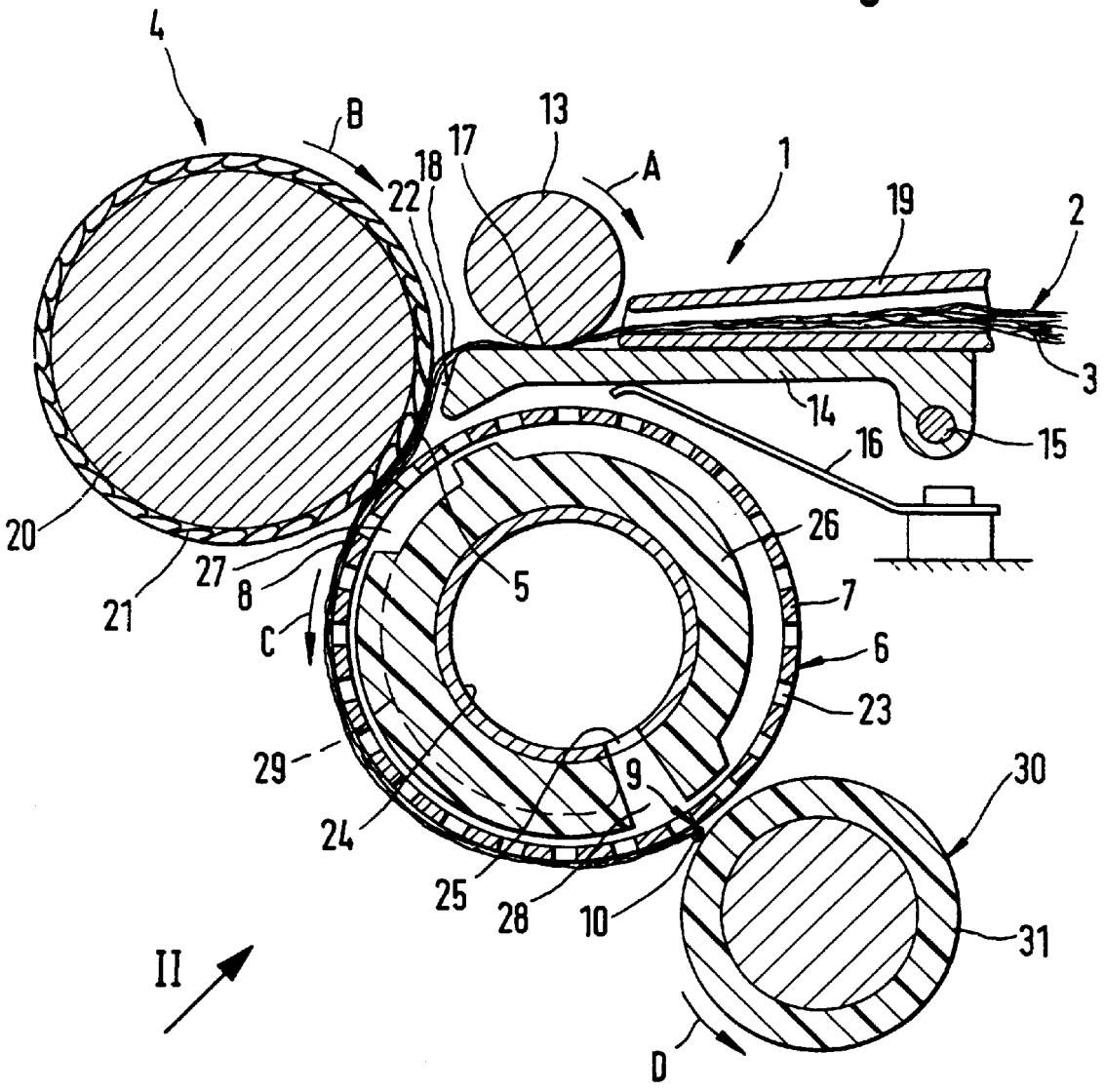
FIG. 1 is a sectional side view of a device with which the spinning process of the present invention is carried out.
Figure 2:
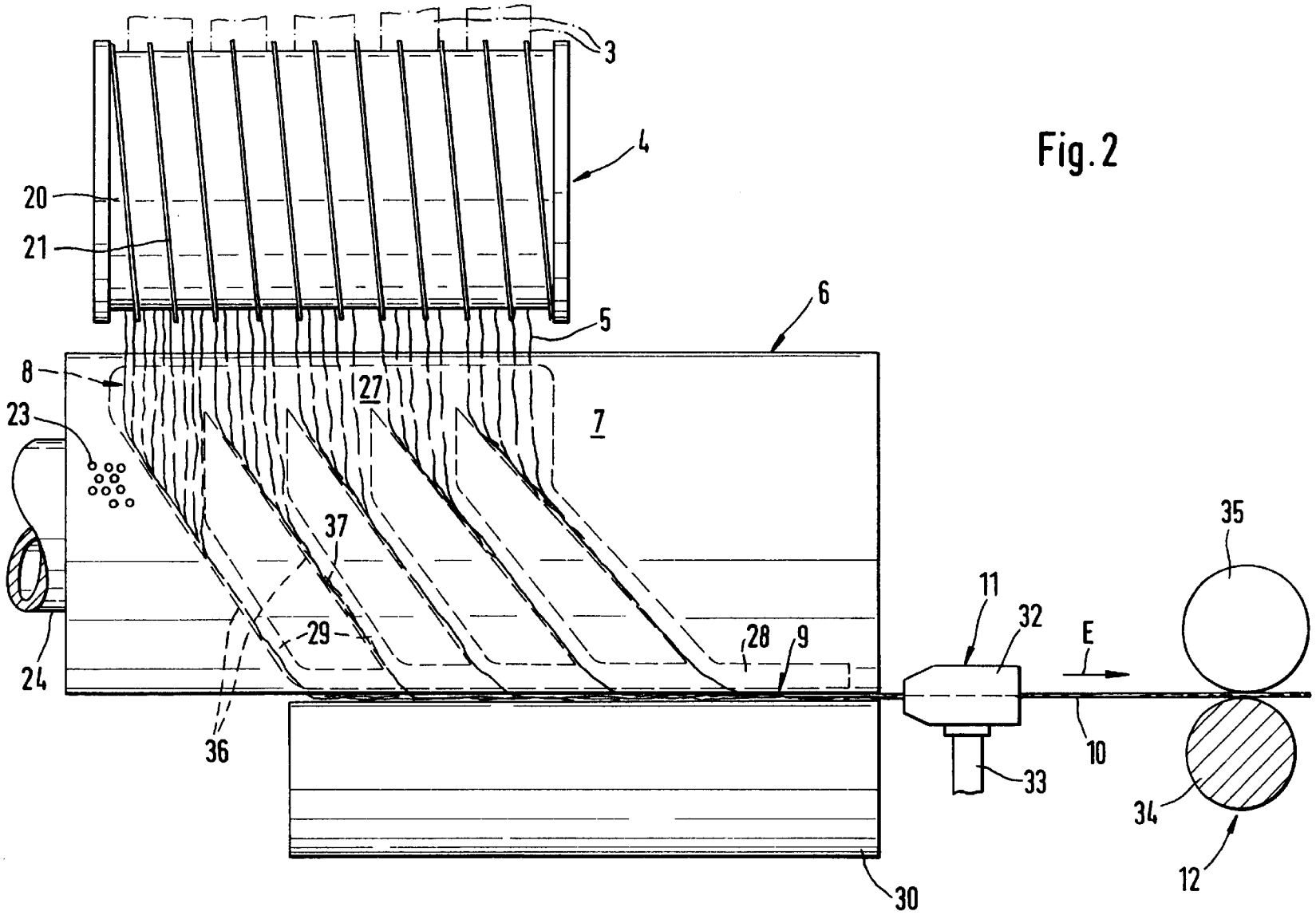
FIG. 2 is a view in the direction of the arrow II of FIG. 1.

The arrangement according to FIGS. 1 and 2 comprises a feed device 1 for feeding fiber material 2 to be spun, which consists of a plurality of slivers 3, preferably arranged adjacently to and at a spacing from one another. The arrangement comprises further an opening device 4 for opening the fed fiber material 2 into single fibers 5, a rotating suction roller 6 whose peripheral surface serves as a collecting surface 7 for taking up the fibrous veil 8 formed from the single fibers 5 and which feeds the fiber material 2 to a yarn formation line 9 arranged transversely to the transport direction of the collecting surface 7, in which yarn formation line 9 the yarn 10 forms. The arrangement comprises further a twist-giving device 11 for spinning in the single fibers 5 into the forming yarn 10 which has a constantly renewing yarn tip, and also comprises a withdrawal device 12 for withdrawing the spun yarn 10 as well as a winding device (not shown).

The feed device 1 comprises a feed roller 13 rotating in rotational direction A, to which feed roller 13 at least one feed table 14, according to the composition of the slivers 3, is arranged. The feed table 14 is pivotable around a swivel axle 15 under the action of a loading spring 16 and forms during operation together with the feed table 13 a nipping point 17, downstream from which the fiber material 2 forms a so-called fiber beard 18. The feed roller 13 is arranged downstream of a feed condenser 19.

The opening device 4 comprises an opening roller 20 rotating in direction B, whose circumference is mounted in the known way with combing structure 21, with which the fiber beard 18 is opened into single fibers 5. The effective width of the opening roller 20 corresponds to the effective width of the suction roller 6 and the width of the fibrous veil 8. The fiber beard 18 is pressed from the other side into the combing structure 21 by a fiber beard support 22 which is allocated to the feed table 14.

The suction roller 6 already mentioned is arranged directly adjacent to the opening roller 20, the circumferential speed of said suction roller 6 being adjusted to the momentary speed of the opened single fibers 5. The periphery of the suction roller 6 is made air-permeable by means of perforations 23, whereby in the interior of the suction roller 6 a suction device is applied so that the fibrous veil 8 is securely taken up on the collecting surface 7 and transported in the transport direction. In order to achieve the object of the present invention, described below, the transport path of the collecting surface 7 should not be too small, so that the diameter of the suction roller 6 is in the range between 80 and 120 mm according to especially preferred embodiments of the present invention.

The suction device contained in the inside of the suction roller 6 comprises a suction tube 24, on which the suction roller 6 is supported in a way not shown here. The suction tube 24 is provided in the area of the yarn formation line 9 with a suction opening 25. Inside of the suction roller 6, a suction insert 26 is adjustably supported on the suction tube 24, which suction insert 26 defines the area in which the single fibers 5 are held on the circumferential surface of the suction roller 6.

The suction insert 26 defines first an initial suction zone 27, which extends over the effective width of the suction roller 6 and which is applied in that area in which the fibrous veil 8 impacts onto the collecting surface 7. The suction insert 26 defines further a main suction slit 28 which is located in the area of the yarn formation line 9 and which extends essentially transversely to the transport direction of the suction roller 6. The initial suction zone 27 and the more strongly suctioned main suction slit 28 are connected by means of a series of suction slits 29 (see in particular FIG. 2), which extend inclined to the yarn formation line 9, with a component thereto, and whose length corresponds approximately to the transport path. The significance of the suction slits 29 is described below.

Even if the circumferential speed of the suction roller 6 must meet the above mentioned requirements, it is still capable of imparting a certain pre-twist to the forming yarn 10 in the yarn formation line 9. The pre-twist can be increased when a friction roller 30 is arranged at the yarn formation line 9, which friction roller 30 forms a wedge-shaped gap together with the suction roller 6 in the area of the yarn formation line 9, which wedge-shaped gap is known generally from friction spinning. The friction roller 30 is driven in the same direction as the suction roller 6, that is in rotational direction D and can also be formed as a suction roller. As shown in FIG. 1 however, the friction roller 30 is shown with a friction lining. Should a higher strength be desirable in the formation phase of the yarn 10, the friction roller 30 can be disposed clamped on the suction roller 6.

The main twist of the forming yarn 10 can be applied by means of a separate twist device, in the case of the present invention by means of an air jet 32 belonging to the twist device 11, as is known in principle from pneumatic false twist spinning. By means of the suction roller 6 and the friction roller 30 forming the friction roller pair on the one hand and the air jet 32 on the other hand, the final twist of the yarn 10 is applied in two stages. The air jet 11 is provided in a known way with a compressed-air supply 33.

In withdrawal direction E of the yarn 10, the above mentioned withdrawal device 12 is arranged downstream of the air jet 32, which withdrawal device 12 comprises a driven bottom roller 34 and a pressure roller 35 which is disposed flexibly thereon. From there the yarn 10 reaches a winding device, where it is wound into a cross package.

The above mentioned suction slits 29, in the case of the present embodiment five in all, are inclined in withdrawal direction E in relation to the yarn formation line 9 and graduate into the yarn formation line 9 in a gentle curve. In the opposite direction to the withdrawal direction E, the individual suction slits 29 each have a guiding edge 36, along which the fiber material 2 is imparted a certain pre-twist.

The fibrous veil 8 is at first taken up in a closed form on the collecting surface 7 in the above mentioned initial suction zone 27, that is in a first section of the transport path of the collecting surface 7, and subsequently grouped into single fiber accumulations, so-called strands 37. These strands 37 are bundled along the respective guiding edges 36, and the closer they come to the yarn formation line 9, the more they receive a certain degree of twist. The degree of twist is determined by the angle of inclination of the guiding edges 36. When the angle of the guiding edges 36 corresponds to a large extent to the transport direction of the collecting surface 7, the strands 37 receive a high transport force and little twist. When the angle of the guiding edges 36 is increased with respect to the transport direction, the degree of twist is increased in the strands 37 and the transport force reduced. With the choice of angle of the guiding edges 36 it is possible to achieve a high transport force and a certain twist applied gradually at that point where the fibrous veil 8 is divided and becomes the strands 37. The tips of the strands 37 which form cannot hereby hang down.

The starting point for the spinning process is therefore a very wide fiber beard 18, to which a correspondingly wide fibrous veil 8 corresponds. The speed of the fibrous veil 8 should not be higher than the withdrawal speed of the yarn 10 along the yarn formation line 9. Before reaching the yarn formation line 9, the fibrous veil 8 is divided into a plurality of fiber accumulations and laterally rolled up along the respective guiding edges 36. The fiber accumulations become pre-twisted strands 37 in a plurality of roll areas arranged at the suction slits 29. These strands 37 are guided off at an angle to the yarn formation line 9, whereby the degree of twist imparted and the transport force is determined by the angle. The strands 37 can be set at various different angles, according to whatever spinning result is required. The pre-twisted strands 37 are wound around each other along the yarn formation line 9 so that the yarn 10 obtains a ply-yarn-like character. It could be said that the strands 37 behave similarly to the single fibers in friction spinning.

The necessary twist is more easily applied to the forming yarn 10 when the withdrawal speed is not too high. For this reason, the fibrous veil 8 should be brought onto the collecting surface 7 at the lowest possible speed. It is therefore provided that the collecting surface 7 takes up the single fibers 5 directly after the fiber beard 18 has been opened. The fibrous veil 8, subsequently divided into strands 37, is reunited with the other strands at the yarn formation line 9 and bound into the forming yarn 10.

Figure 3:
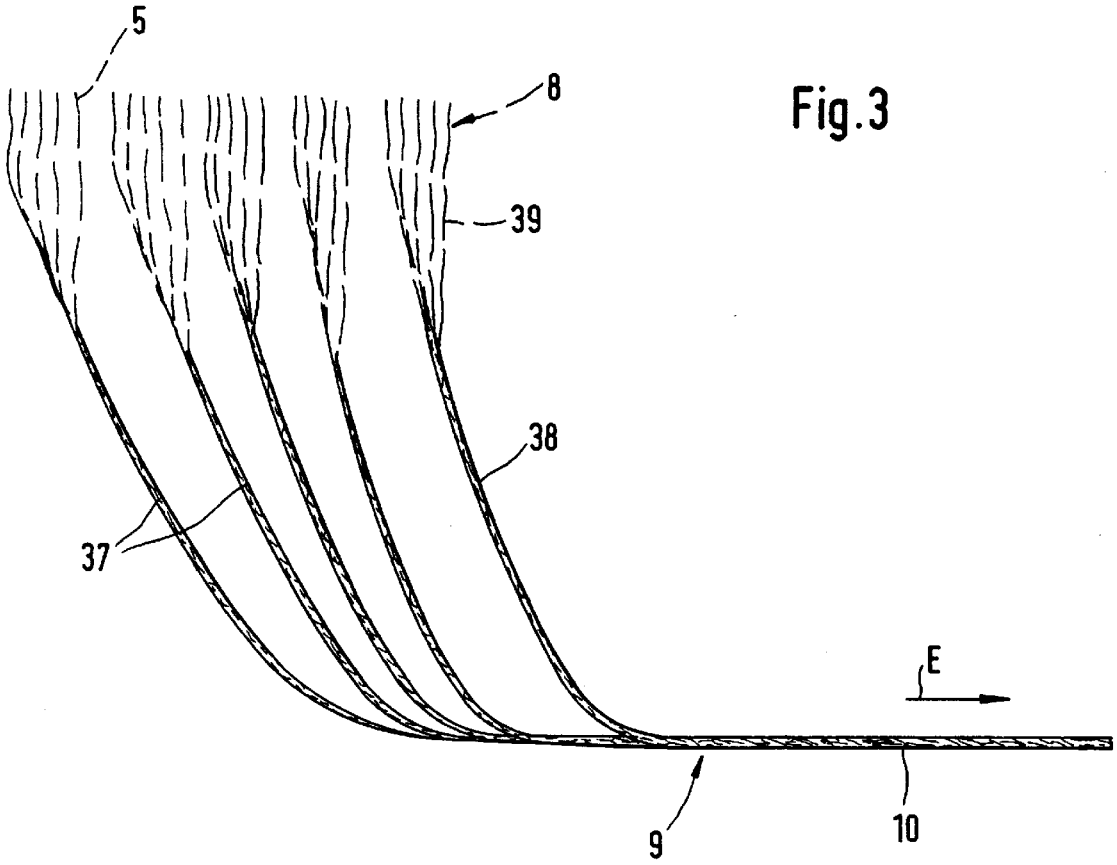
FIG. 3 is a schematic representation of the formation phase of the yarn of the present invention, based on FIG. 2.

FIG. 3 is simply a schematic drawing which explains the spinning process and demonstrates the individual phases of the forming yarn 10. Recognizable is the fibrous veil 8, comprising single fibers 5, which veil is grouped into five individual strands 37. It is advantageous when one sliver 3 is provided for each strand 37. The individual strands 37 graduate into the yarn formation line 9 at the smallest possible distance from each other. This means that the individual strands 37 are at different angles to the yarn formation line 9. One can see that the angle of the individual strands 37 to the yarn formation line 9 continuously increases, which means that, as seen in transport direction of the collecting surface 7, at first the transport force and later the degree of twist predominates.

As can be seen from FIG. 3, the last strand 38 in withdrawal direction E is set aside somewhat from the other strands 37. This means that the single fibers forming the strand 38, the so-called outer fibers 39, are practically bound into the yarn 10 when its twist is already almost completed. This results in a particularly soft and good grip of the outer layer of the yarn 10. For the purpose of the invention, it is useful when the main suction slit 28 arranged at the yarn formation line 9 is more strongly suctioned.

Figure 4:
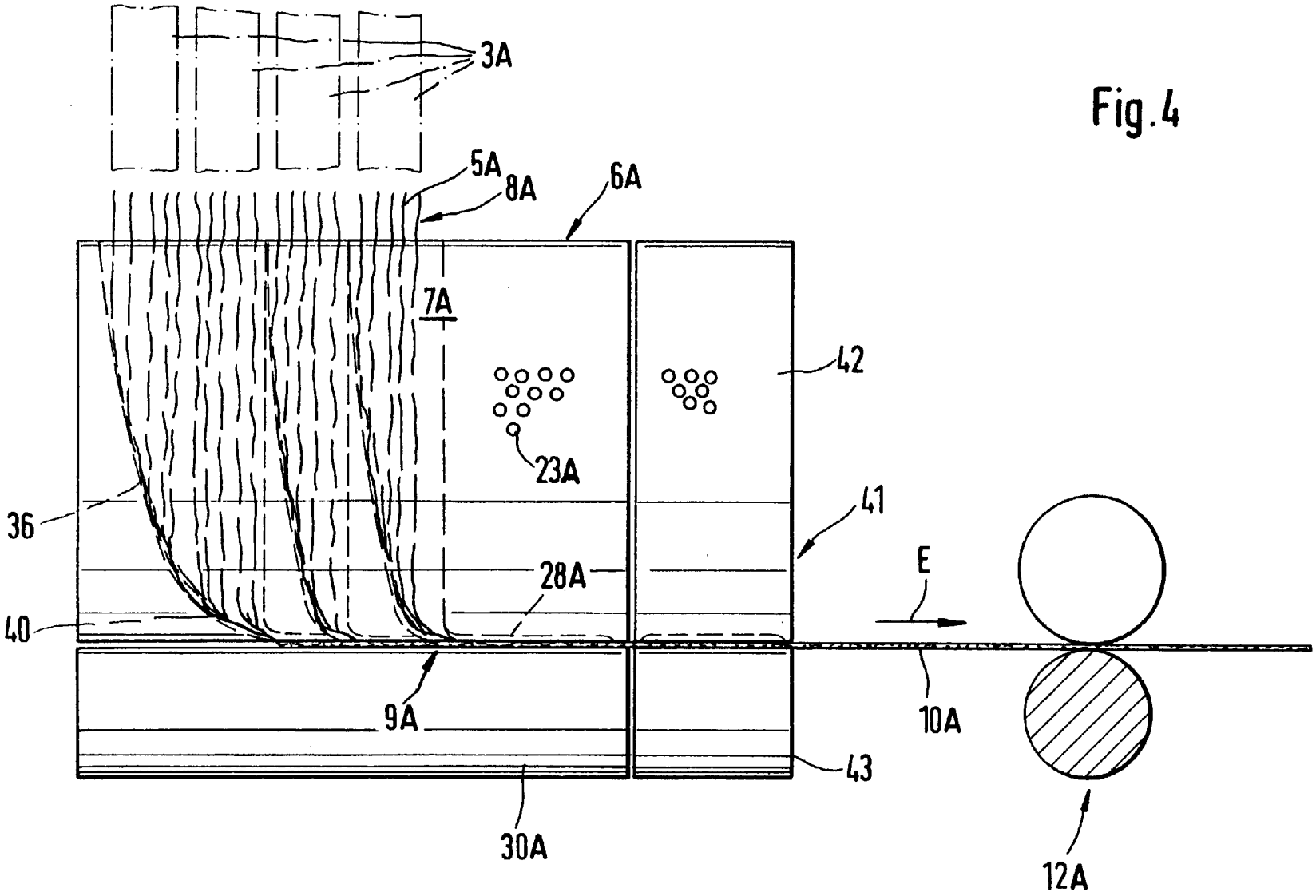
FIG. 4 is a view similar to FIG. 2, comprising a friction roller pair arranged downstream of the collecting surface.

In the embodiment of FIG. 4, similar reference numbers as used in FIGS. 1–3 are used, with a suffix "A", to designate corresponding generally similar features as described above with respect to FIGS. 1–3. Unless otherwise indicated, the description of the embodiment of FIGS. 1–3 can be referred to.

The embodiment according to FIG. 4 differs firstly in that the single fibers 5A of two slivers 3A are provided for forming the first strand 40. The slivers 3A are denoted only by dot-dash lines. This results in the actual tip of the forming yarn 10A being blunter and containing more fibers, so that a hanging down of the yarn tip is avoided.

The extent of the twist of the strands 37 and 40 is dependent, as already mentioned, on their angle of motion. The more the slant in travelling direction diverges from the radial plane of the collecting surface 7, 7A and approaches the longitudinal axis, the more rolling up of the single fibers 5, 5A to the strands 37, 40 is obtained, and the less accentuated is the transport component. The length of the respective suction slit 29 also plays a role. The longer the transport path is, the longer the single fibers 5 belonging to a strand 37,40 are subjected to a rolling up movement.

If as much transport force as possible is required and at the same time also much rolling up, the diameter of the suction roller 6, 6A must inevitably be kept large. A diameter of between 80 to 120 mm is thus desirable. This results in a reliable transport force and at the same time sufficient twist impartation. Particular effects can be achieved by means of the yarn strands 37,40 in the spinning process described above. Each strand 37,40 can, as desired, consist of a different fiber material 2 or even have different colors. Fashionable effects can thus be produced.

Instead of the air jet 32 of the embodiment in FIGS. 1 and 2, a second roller pair 41 is provided in the embodiment in FIG. 4. This second roller pair 41 can comprise a second suction roller 42 as well as a second friction roller 43, or, as in friction spinning, the said second roller pair 41 can comprise two suction rollers. The second roller pair 41 is driven independently of the suction roller 6A and can thus run at the most favorable speed for twist impartation. The surface speed of the second roller pair 41 has no influence on the Yarn transPort.

The circumferential speed of the friction roller 30, 30A arranged adjacent the suction roller 6, 6A is less critical than the circumferential speed of the suction roller 6, 6A. The friction roller 30, 30A can therefore run faster than the suction roller 6, 6A as a certain slip along the yarn formation line 9, 9A has to be reckoned with.

Figure 5:
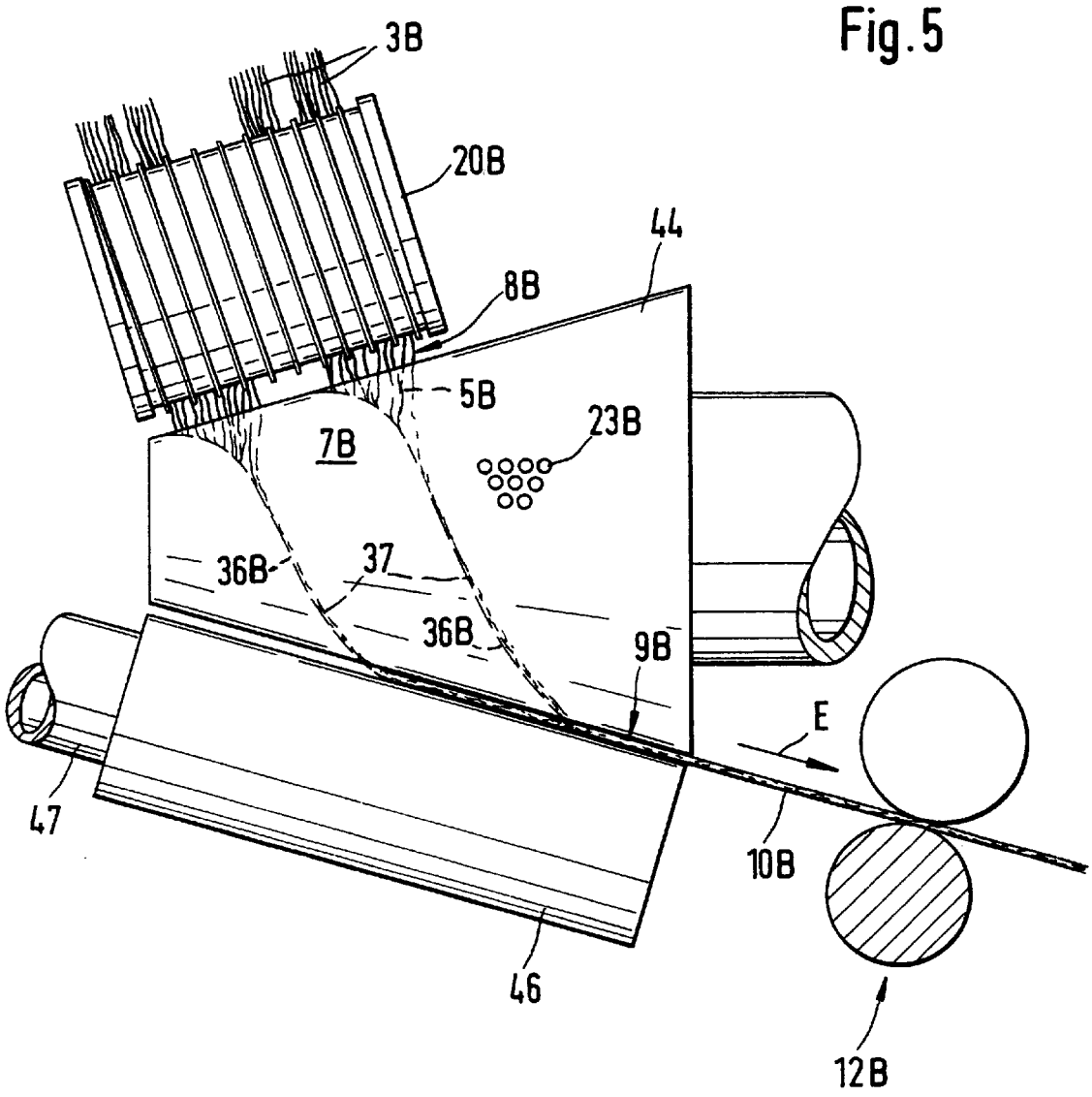
FIG. 5 is a view similar to FIG. 2 showing another embodiment wherein the suction roller comprising the collecting surface is conically formed.

In the embodiment of FIG. 5, similar reference numbers as used in FIGS. 1–3 are used, with a suffix "B", to designate corresponding generally similar features as described above with respect to FIGS. 1–3. Unless otherwise indicated, the description of the embodiment of FIGS. 1–3 can be referred to.

The embodiment in FIG. 5 differs from the previous embodiments essentially in that the suction roller 44 comprising the collecting surface 7B is conically formed. The larger diameter hereby faces the withdrawal device 12B. Due to the conical form, the surface speed along the guiding edges 36B becomes increasingly faster. The single fibers 5B bound into the strands 37B thus receive at the same time a certain stretching.

In the area of the yarn formation line 9B, a cylindrical friction roller 46 is provided, which is supported on a suction tube 47. The friction roller 46 is therefore suctioned and contributes considerably to the twist formation. In view of this, a separate twist device may be omitted.

Figure 6:
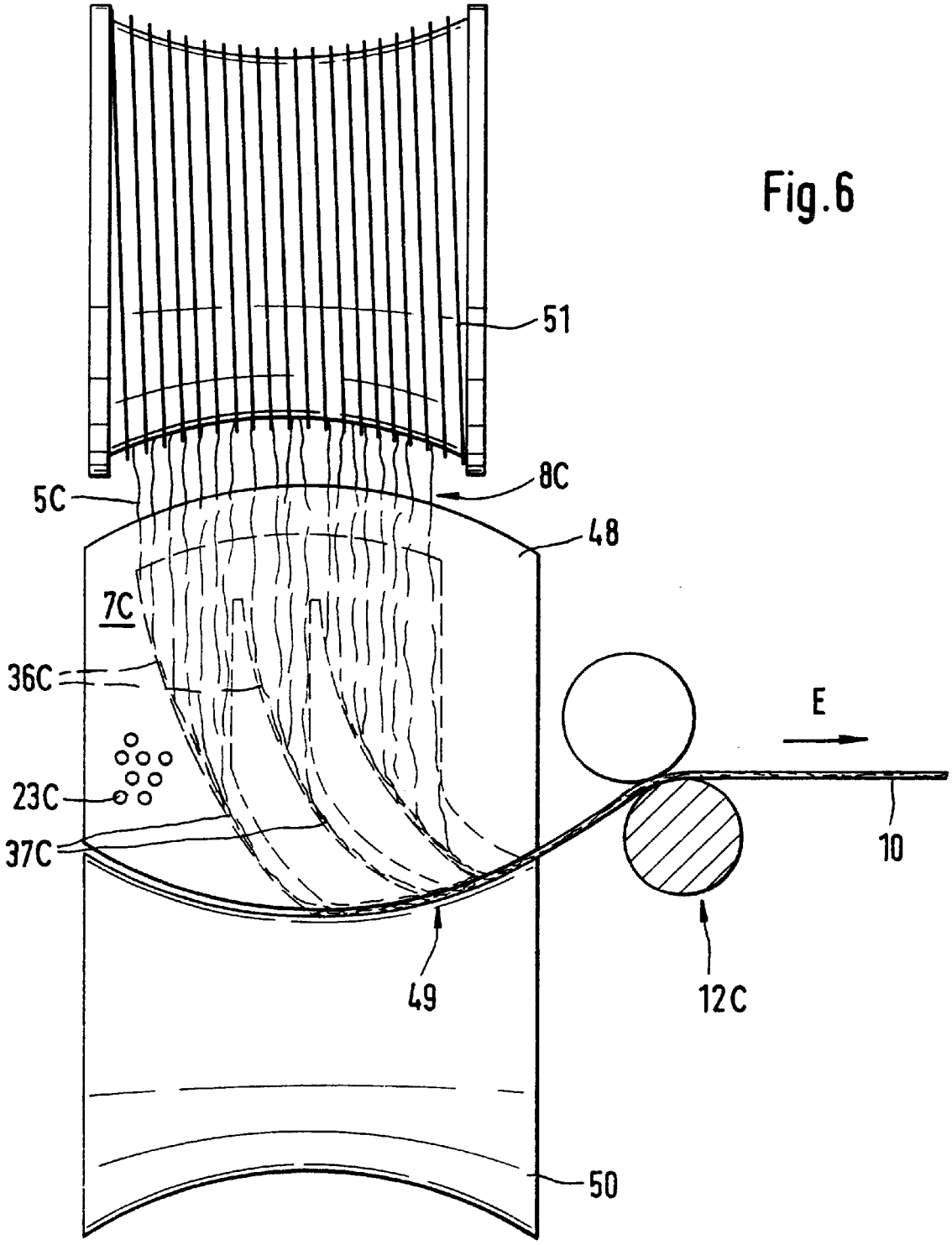
FIG. 6 is a representation similar to FIG. 2, wherein the suction roller comprising the collecting surface is dished.

In the embodiment of FIG. 6, similar reference numbers as used in FIGS. 1–3 are used, with a suffix "C", to designate corresponding generally similar features as described above with respect to FIGS. 1–3. Unless otherwise indicated, the description of the embodiment of FIGS. 1–3 can be referred to.

According to the embodiment in FIG. 6, the collecting surface 7 is located on the periphery of a dished suction roller 48. A curved yarn formation line 49 results therefrom, whereby during yarn formation a certain longitudinal tension builds. The yarn strength is favorably influenced thereby. The friction roller 50 provided as a counter roller along the yarn formation line 49 is correspondingly convex in form.

As can be seen, the circumferential surface of the opening roller 51 is, in the case of the present invention, concave and is thus also adapted to the curve of the suction roller 48.

In the following FIGS. 7 to 11 several examples are shown as to how the single strands 37 can be guided on the relevant collecting surface 7.

Figure 7:
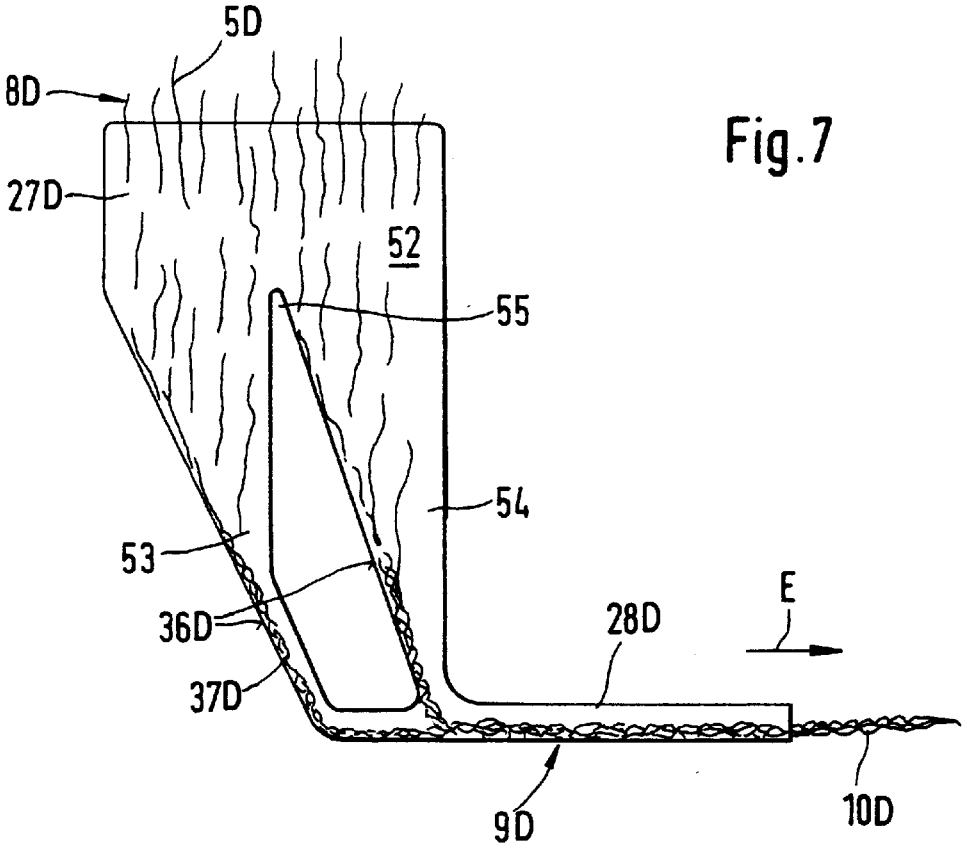
FIGS. 7 to 11 are schematic representations of the suction area used for the formation of the strands according to respective embodiments of the invention.

In the embodiment of FIG. 7, similar reference numbers as used in FIGS. 1–3 are used, with a suffix "D", to designate corresponding generally similar features as described above with respect to FIGS. 1–3. Unless otherwise indicated, the description of the embodiment of FIGS. 1–3 can be referred to.

A suction area 52 is provided in the suction insert 2 6 not shown further in FIG. 7, in which the fibrous veil 8D consisting of the single fibers 5D is at first closed over the entire effective width of the collecting surface 7D in an initial suction zone 27D. This means that the suction slits 53 and 54 do not begin immediately for the strands 37D.

After a short transport path for the fibrous veil 8D, it is then divided as a result of the suction area 52. The prevailing factor therefore is the unsuctioned tip 55. The single fibers 5D of the fibrous veil 8D move in vertical direction, that is corresponding to the circumferential speed of the suction roller 6D, until they reach the relevant guiding edge 36D. Only then does the rolling up of the single fibers 5D to strands 37D begin and thus the impartation of a certain degree of pre-twist. The suction slits 53 and 54 can themselves be kept very narrow; a width of 3 to 5 mm is sufficient.

Figure 8:
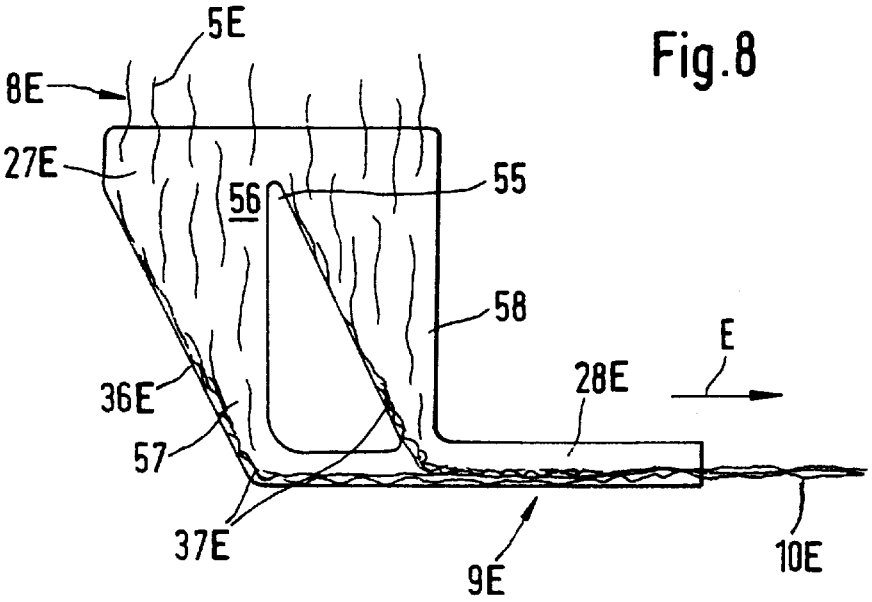

In the embodiment of FIG. 8, similar reference numbers as used in FIGS. 1–3 are used, with a suffix "E", to designate corresponding generally similar features as described above with respect to FIGS. 1–3. Unless otherwise indicated, the description of the embodiment of FIGS. 1–3 can be referred to.

According to FIG. 8, a suction area 56 is provided, whose suction slits 57 and 58 constantly taper towards the yarn formation line 9E. In this case of the present invention, single fibers 5E are still fed, up to the yarn formation line 9E, to the strands 37E which are already forming.

Figure 9:
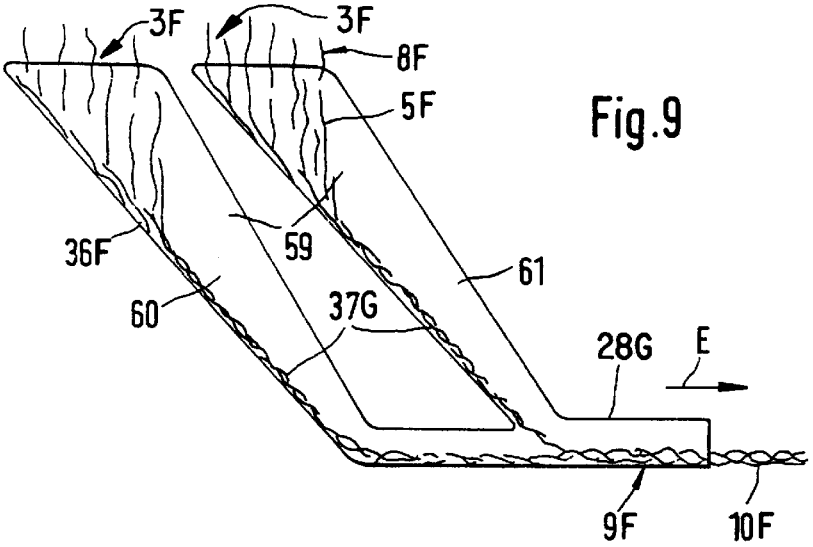

In the embodiment of FIG. 9, similar reference numbers as used in FIGS. 1–3 are used, with a suffix "F", to designate corresponding generally similar features as described above with respect to FIGS. 1–3. Unless otherwise indicated, the description of the embodiment of FIGS. 1–3 can be referred to.

In the embodiment in FIG. 9, no initial suction zone 27, arranged upstream of the individual suction slits 60 and 61, is arranged at the suction area 59. Each suction slit 60, 61 has rather more its own relatively wide starting area. In this case of the present invention, it is advantageous when the fed slivers 3F are kept at a certain distance from one another, so that a fibrous veil 8F is generated from each sliver 3. The tapering of the suction slits 60 and 61 has a similar effect to the one shown in FIG. 8.

Figure 10:
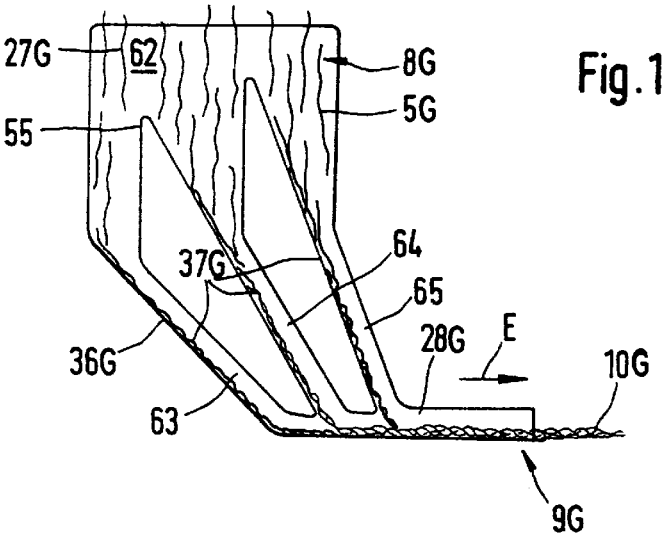

In the embodiment of FIG. 10, similar reference numbers as used in FIGS. 1–3 are used, with a suffix "G", to designate corresponding generally similar features as described above with respect to FIGS. 1–3. Unless otherwise indicated, the description of the embodiment of FIGS. 1–3 can be referred to.

According to the embodiment in FIG. 10, the suction slits 63, 64 and 65 allocated to the suction area 62 are so formed that they begin together at an initial suction zone 27G and draw increasingly closer to each other in the direction towards the yarn formation line 9G. Thus the individual guiding edges 36G each have different inclinations In the embodiment of FIG. 11, similar reference numbers as used in FIGS. 1–3 are used, with a suffix "H", to designate corresponding generally similar features as described above with respect to FIGS. 1–3. Unless otherwise indicated, the description of the embodiment of FIGS. 1–3 can be referred to.

Figure 11:
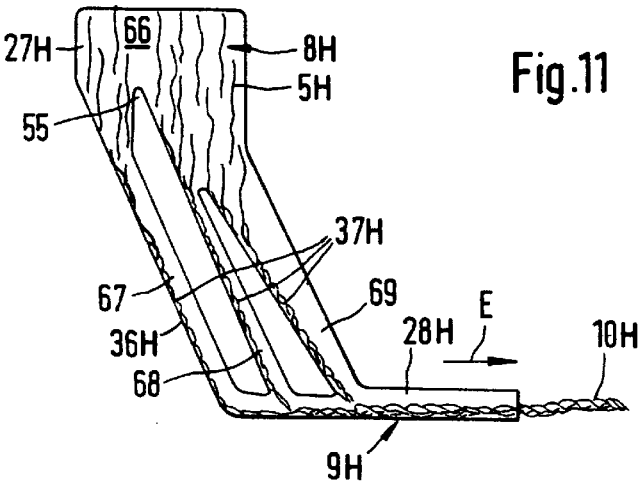

In contrast, it is provided in FIG. 11 that the suction slits 67, 68 and 69 allocated to the suction area 66 are divergently formed in the direction towards the yarn formation line 9H.

In all the embodiments in FIGS. 7 to 11, each main suction slit 28D–28H is more strongly suctioned in order to impart a good twist to the forming yarn 10D–10H in a short a time as possible.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spinning process for producing yarn, comprising the steps:

feeding fiber material to an opening device, opening the fiber material to single fibers in the form of a fibrous veil, feeding the fibrous veil to an air-permeable and suctioned collecting surface with said collecting surface increasing the velocity of fibers of the fibrous veil fed thereto, transporting said fibrous veil by means of said collecting surface along a transport path, dividing the fibrous veil along a transport path on the collecting surface and imparting a twist to perform a plurality of pretwisted strands, transporting the pretwisted strands by means of said collecting surface to a yarn formation line, uniting the strands with each other while binding them into a yarn forming along the yarn formation line, imparting a twist to the yarn, and withdrawing the yarn from the yarn formation line transversely to the transport direction of the collecting surface.

2. A spinning process according to claim 1, wherein the yarn withdrawal speed is at least approximately the same as the transport speed of the collecting surface.

3. A spinning process according to claim 2, wherein the single fibers forming the fibrous veil are accelerated when they reach the collecting surface.

4. A spinning process according to claim 3, wherein the fibrous veil is transferred to the collecting surface directly after the fiber material has been opened to single fibers.

5. A spinning process according to claim 4, wherein the fibrous veil is formed of a plurality of preferably spaced, adjacently fed slivers.

6. A spinning process according to claim 5, wherein a first of said strands in a withdrawal direction of the yarn is fed more single fibers than the other of said strands.

7. A spinning process according to claim 3, wherein the fibrous veil is formed of a plurality of preferably spaced, adjacently fed slivers.

8. A spinning process according to claim 3, wherein a first of said strands in a withdrawal direction of the yarn is fed more single fibers than the other of said strands.

9. A spinning process according to claim 3, wherein the yarn formed at the yarn formation line is pressed to the collecting surface by means of clamping.

10. A spinning process according to claim 3, wherein the twist imparted to the forming yarn is applied in plural stages including a first stage applied at the yarn formation line on the collecting surface and a second stage applied downstream of the yarn formation line.

11. A spinning process according to claim 3, wherein the single strands are fed at respective different angles to the yarn formation line.

12. A spinning process according to claim 3, wherein the strands are transported into the yarn formation line over a gently rounded transition point.

13. A spinning process according to claim 3, wherein the last strand in a withdrawal direction of the yarn is fed to form predominantly outer fibers of the yarn withdrawn from the yarn formation line.

14. A spinning process according to claim 1, wherein the single fibers forming the fibrous veil are accelerated when they reach the collecting surface.

15. A spinning process according to claim 1, wherein the fibrous veil is transferred to the collecting surface directly after the fiber material has been opened to single fibers.

16. A spinning process according to claim 1, wherein the fibrous veil is formed of a plurality of preferably spaced, adjacently fed slivers.

17. A spinning process according to claim 16, wherein the yarn formed at the yarn formation line is pressed to the collecting surface by means of clamping.

18. A spinning process according to claim 6, wherein the twist imparted to the forming yarn is applied in plural stages including a first stage applied at the yarn formation line on the collecting surface and a second stage applied downstream of the yarn formation line.

19. A spinning process according to claim 16, wherein the single strands are fed at respective different angles to the yarn formation line.

20. A spinning process according to claim 1, wherein a first of said strands in a withdrawal direction of the yarn is fed more single fibers than the other of said strands.

21. A spinning process according to claim 20, wherein the yarn formed at the yarn formation line is pressed to the collecting surface by means of clamping.

22. A spinning process according to claim 1, wherein the yarn formed at the yarn formation line is pressed to the collecting surface by means of clamping.

23. A spinning process according to claim 22, wherein the twist imparted to the forming yarn is applied in plural stages including a first stage applied at the yarn formation line on the collecting surface and a second stage applied downstream of the yarn formation line.

24. A spinning process according to claim 23, wherein the single strands are fed at respective different angles to the yarn formation line.

25. A spinning process according to claim 1, wherein the twist imparted to the forming yarn is applied in plural stages including a first stage applied at the yarn formation line on the collecting surface and a second stage applied downstream of the yarn formation line.

26. A spinning process according to claim 1, wherein the single strands are fed at respective different angles to the yarn formation line.

27. A spinning process according to claim 1, wherein the strands are transported into the yarn formation line over a gently rounded transition point.

28. A spinning process according to claim 1, wherein the last strand in a withdrawal direction of the yarn is fed to form predominantly outer fibers of the yarn withdrawn from the yarn formation line.

29. A yarn spinning apparatus comprising:

an opening device operable to open fiber material to single fibers in the form of a fibrous veil, an air-permeable and suctioned collecting surface device operable in use to receive and transport the fibrous veil along a transport path to a yarn formation line, said collecting surface in use increasing the velocity of fibers of the fibrous veil received thereby, a fibrous veil divider operable to divide the fibrous veil along the transport path into a plurality of sections, pretwist imparting structure at the collecting surface device operable to impart a twist to the sections to form pretwisted strands, and a yarn withdrawal device operable to withdraw the strands along the yarn formation line while uniting the strands with each other.

30. A yarn spinning apparatus according to claim 29, wherein said yarn withdrawal device and collecting surface are configured to provide a yarn withdrawal speed approximately the same as a transport speed of the collecting surface.

31. A yarn spinning apparatus according to claim 30, wherein the collecting surface is a peripheral surface of a suction roller, in whose inside a suction insert which determines the transport path and the yarn formation line is arranged, which suction insert comprises individual suction slits which serve to divide the fibrous veil into strands, each of said individual suction slits extending with a guiding edge inclined in withdrawal direction of the yarn into a main suction slit which determines the yarn formation line.

32. A yarn spinning apparatus according to claim 29, wherein the collecting surface is a peripheral surface of a suction roller, in whose inside a suction insert which determines the transport path and the yarn formation line is arranged, which suction insert comprises individual suction slits which serve to divide the fibrous veil into strands, each of said individual suction slits extending with a guiding edge inclined in withdrawal direction of the yarn into a main suction slit which determines the yarn formation line.

33. A yarn spinning apparatus according to claim 32, wherein the individual suction slits are formed so that they taper in a yarn transport direction.

34. A yarn spinning apparatus according to claim 32, wherein the individual suction slits, starting from an initial suction zone which extends over the entire effective width of the collecting surface, begin after a section of the transport path.

35. A yarn spinning apparatus according to claim 34, wherein the guiding edges of the individual suction slits are inclined at various angles in the direction towards the main suction slit.

36. A yarn spinning apparatus according to claim 35, wherein the main suction slit is more strongly suctioned than the individual suction slits arranged adjacent the strands.

37. A yarn spinning apparatus according to claim 36, wherein the angle of inclination of the guiding edges increases in a yarn transport direction.

38. A yarn spinning apparatus according to claim 37, wherein a friction roller is arranged adjacent the suction roller in the area of the yarn formation line.

39. A yarn spinning apparatus according to claim 32, wherein the guiding edges of the individual suction slits are inclined at various angles with respect to one another in the direction towards the main suction slit.

40. A yarn spinning apparatus according to claim 32, wherein the main suction slit is more strongly suctioned than the individual suction slits arranged adjacent the strands.

41. A yarn spinning apparatus according to claim 32, wherein the angle of inclination of the guiding edges increases in a yarn transport direction.

42. A yarn spinning apparatus according to claim 32, wherein a friction roller is arranged adjacent the suction roller in the area of the yarn formation line.

43. A spinning process for producing yarn, comprising the steps:

feeding fiber material to an opening device, opening the fiber material to single fibers in the form of a fibrous veil, feeding the fibrous veil to an air-permeable and suctioned collecting surface, transporting said fibrous veil by means of said collecting surface along a transport path, dividing the fibrous veil along a transport path on the collecting surface and imparting a twist to perform a plurality of pretwisted strands, transporting the pretwisted strands by means of said collecting surface to a yarn formation line, uniting the strands with each other while binding them into a yarn forming along the yarn formation line, imparting a twist to the yarn, and withdrawing the yarn from the yarn formation line transversely to the transport direction of the collecting surface, wherein the yarn withdrawal speed is at least approximately the same as the transport speed of the collecting surface.

44. A yarn spinning apparatus comprising:

an opening device operable to open fiber material to single fibers in the form of a fibrous veil, an air-permeable and suctioned collecting surface device operable in use to receive and transport the fibrous veil along a transport path to a yarn formation line, a fibrous veil divider operable to divide the fibrous veil along the transport path into a plurality of sections, pretwist imparting structure at the collecting surface device operable to impart a twist to the sections to form pretwisted strands, and a yarn withdrawal device operable to withdraw the strands along the yarn formation line while uniting the strands with each other, wherein said yarn withdrawal device and collecting surface are configured to provide a yarn withdrawal speed approximately the same as a transport speed of the collecting surface.

45. A yarn spinning apparatus comprising:

an opening device operable to open fiber material to single fibers in the form of a fibrous veil, an air-permeable and suctioned collecting surface device operable in use to receive and transport the fibrous veil along a transport path to a yarn formation line, a fibrous veil divider operable to divide the fibrous veil along the transport path into a plurality of sections, pretwist imparting structure at the collecting surface device operable to impart a twist to the sections to form pretwisted strands, and a yarn withdrawal device operable to withdraw the strands along the yarn formation line while uniting the strands with each other, wherein the collecting surface is a peripheral surface of a suction roller, in whose inside a suction insert which determines the transport path and the yarn formation line is arranged, which suction insert comprises individual suction slits which serve to divide the fibrous veil into strands, each of said individual suction slits extending with a guiding edge inclined in withdrawal direction of the yarn into a main suction slit which determines the yarn formation line, and wherein the main suction slit is more strongly suctioned than the individual suction slits arranged adjacent the strands.

46. A yarn spinning apparatus comprising:

an opening device operable to open fiber material to single fibers in the form of a fibrous veil, an air-permeable and suctioned collecting surface device operable in use to receive and transport the fibrous veil along a transport path to a yarn formation line, a fibrous veil divider operable to divide the fibrous veil along the transport path into a plurality of sections, pretwist imparting structure at the collecting surface device operable to impart a twist to the sections to form pretwisted strands, and a yarn withdrawal device operable to withdraw the strands along the yarn formation line while uniting the strands with each other, wherein the collecting surface is a peripheral surface of a suction roller, in whose inside a suction insert which determines the transport path and the yarn formation line is arranged, which suction insert comprises individual suction slits which serve to divide the fibrous veil into strands, each of said individual suction slits extending with a guiding edge inclined in withdrawal direction of the yarn into a main suction slit which determines the yarn formation line, and wherein the individual suction slits are formed so that they taper in a yarn transport direction.

* * * * *